US010535262B2

(12) United States Patent
Voigt et al.

(10) Patent No.: US 10,535,262 B2
(45) Date of Patent: Jan. 14, 2020

(54) ACTIVE PEDESTRIAN WARNING SYSTEM FOR RAIL AND BUS TRANSIT ROUTES

(71) Applicants: The Texas A&M University System, College Station, TX (US); Metropolitan Transit Authority of Harris County, Texas, Houston, TX (US)

(72) Inventors: Anthony P. Voigt, Pearland, TX (US); Michael J. Vickich, Houston, TX (US); Micah D. Montoya, Missouri City, TX (US); Terence H. Fontaine, Houston, TX (US); Lauren K. Cochran, Houston, TX (US)

(73) Assignees: The Texas A&M University System, College Station, TX (US); Metropolitan Transit Authority of Harris County, Texas, Houston, TX (US)

( * ) Notice: Subject to any disclaimer, the term of this patent is extended or adjusted under 35 U.S.C. 154(b) by 0 days.

(21) Appl. No.: 15/957,587

(22) Filed: Apr. 19, 2018

(65) Prior Publication Data

US 2018/0308356 A1 Oct. 25, 2018

Related U.S. Application Data

(60) Provisional application No. 62/487,933, filed on Apr. 20, 2017.

(51) Int. Cl.

| | |
|---|---|
| ***G08G 1/123*** | (2006.01) |
| ***G08G 1/09*** | (2006.01) |
| *G08G 1/005* | (2006.01) |

(52) U.S. Cl.

CPC ..... *G08G 1/123* (2013.01); *G08G 1/093* (2013.01); *G08G 1/005* (2013.01)

(58) Field of Classification Search

CPC ..... G08G 1/123; G08G 1/005; G08G 1/093
USPC ..... 340/989
See application file for complete search history.

(56) References Cited

U.S. PATENT DOCUMENTS

2011/0006912 A1* 1/2011 Sheardown ..... B61L 23/06 340/901
2017/0278385 A1* 9/2017 Jevne ..... G08G 1/005

* cited by examiner

*Primary Examiner* — Jack K Wang
(74) *Attorney, Agent, or Firm* — Baker Botts L.L.P.

(57) ABSTRACT

A system includes a transmitter coupled to a vehicle and a client system. The transmitter broadcasts a wireless signal. The client system includes a receiver that receives the wireless signal from the transmitter. The client system determines an identifier within the wireless signal, compares the identifier within the wireless signal to a list of identifiers, and in response to determining that the identifier within the wireless signal matches a particular identifier within the list of identifiers, generates an alert that the vehicle is approaching.

20 Claims, 5 Drawing Sheets

ACTIVE PEDESTRIAN WARNING SYSTEM FOR RAIL AND BUS TRANSIT ROUTES

PRIORITY

This application claims the benefit, under 35 U.S.C. § 119(e), of U.S. Provisional Patent Application No. 62/487,933, filed 20 Apr. 2017, which is incorporated herein by reference.

TECHNICAL FIELD

This disclosure relates in general to warning systems and more particularly to an active pedestrian warning system for rail and bus transit routes.

BACKGROUND

In general, people such as pedestrians frequently come in close contact with dangerous vehicles such as trains and buses. For example, public transportation systems such as light rail trains frequently traverse crowded streets where pedestrians are present. If pedestrians are distracted or are not paying attention to their surroundings, they may be struck and injured by a passing train.

SUMMARY OF THE DISCLOSURE

Embodiments of the disclosure enable a transit vehicle to emit a beacon signal via wireless technology (for example, using the Bluetooth Low Energy protocol) which is then received and used by a two-way personal mobile communicating device (e.g., smartphone), a one-way communicating device (e.g., a beacon signal receiver with visual, tactile or audible alert capability), or a visual or audible messaging system (e.g., a speaker system, visual "strobe" light or other sensory input device) to alert pedestrians, bicyclists, motorists, or other travelers or systems that a transit vehicle is approaching a known location.

Technical advantages of certain embodiments will be readily apparent to one skilled in the art from the following figures, descriptions, and claims. For example, certain embodiments may provide increased safety by providing a warning that a vehicle is approaching. Moreover, while specific advantages have been enumerated above, various embodiments may include all, some, or none of the enumerated advantages.

BRIEF DESCRIPTION OF THE DRAWINGS

For a more complete understanding of the present disclosure and its advantages, reference is made to the following description, taken in conjunction with the accompanying drawings, in which.

DETAILED DESCRIPTION OF THE DISCLOSURE

Increasingly, pedestrians and bicyclists are distracted by the use of electronic devices as they walk and ride. This distraction may cause conflicts near transit routes, stops, and platforms as the pedestrians become less aware of standard warning devices. This distraction on the part of the pedestrian and bicyclist increases the potential for collisions with transit vehicles such as trains and buses. In addition, light-rail and other transit routes have been built into environments where conflicts are inherent (e.g., within streets), but are manageable without a distracted person. For example, a transit vehicle (e.g., rail, light-rail, bus, van, passenger car, etc.) moving along a city street right-of-way or other roadway may pose a risk to pedestrians and bicyclists also using that street or roadway, or to pedestrians or bicyclists crossing the street and crossing the path of the transit vehicle if the pedestrian is not paying attention to existing signs, markings and other warning devices typically found along transit routes.

To address these and other problems, embodiments of the disclosure enable a vehicle (e.g., a transit vehicle such as light-rail, heavy-rail, bus, van, passenger vehicle, etc.) to emit a beacon signal via wireless technology (for example, using the Bluetooth Low Energy (BTLE) protocol) which may be received and used by a two-way personal mobile communicating device (e.g., smartphone), a one-way communicating device (e.g., a beacon signal receiver with visual, tactile or audible alert capability), or a visual or audible messaging system (e.g., a speaker system, visual "strobe" light or other sensory input device) to alert pedestrians, bicyclists, motorists, or other travelers or systems that a vehicle is approaching a known location. The wireless beacon signal may be used to provide an active warning to a user caused by their proximity to a moving transit vehicle, in the absence or presence of other alerting systems, and can do so by preempting that user's real-time use of that device. In some embodiments, a single board computer that produces a continual Bluetooth low energy based beacon signal in an omni-directional pattern is placed on the transit vehicle (e.g., in the front, rear, or both). Carried by pedestrians, bicyclists, or other transportation system users, the receiving device detects the wireless beacon signals and translates them into warnings that may be audible, tactile, visual, or any combination of the above.

Figure 1:
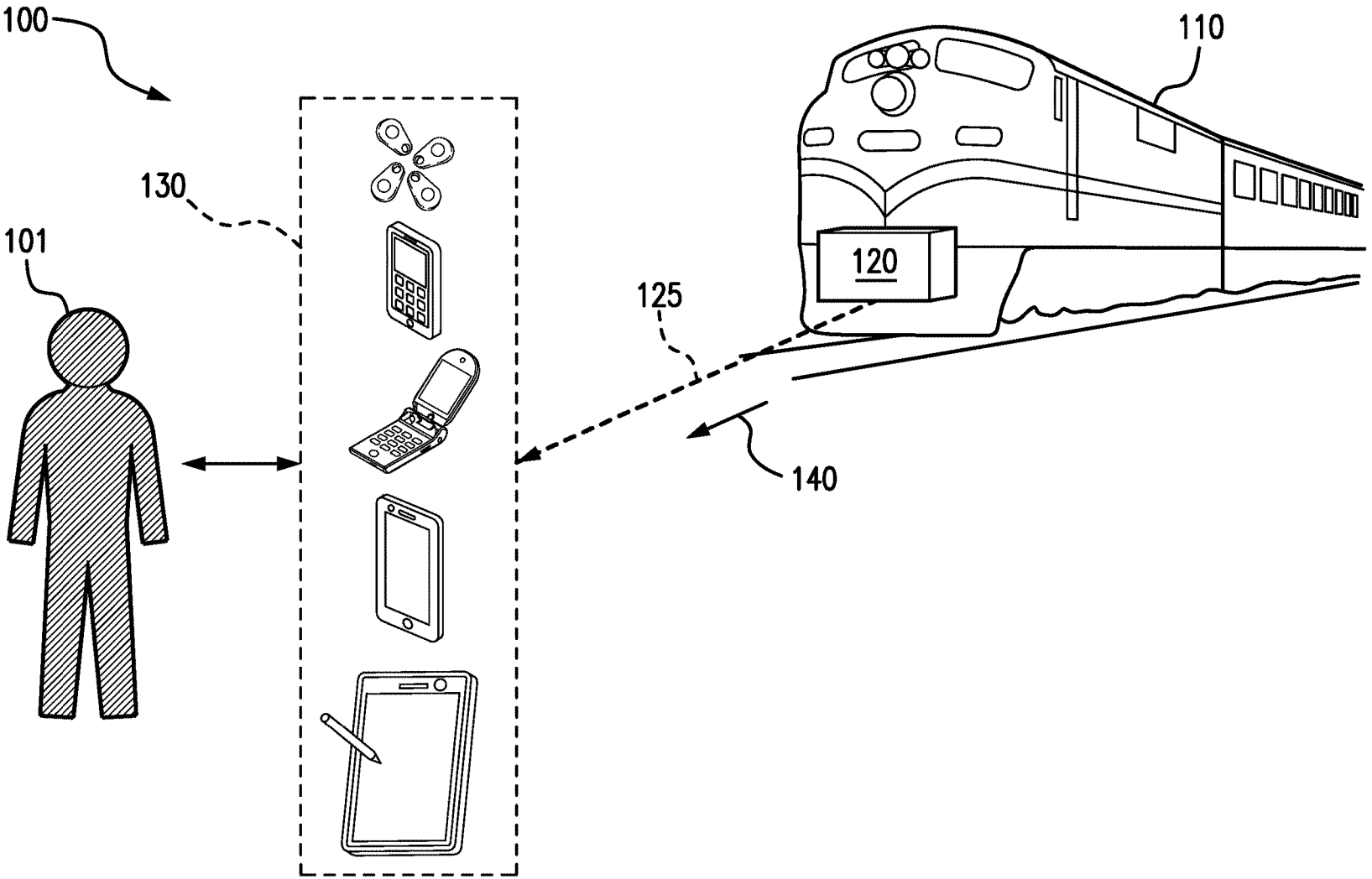
FIGS. 1-2 illustrate warning systems for an approaching vehicle, according to certain embodiments.

FIG. 1 illustrates a warning system 100 for an approaching vehicle, according to certain embodiments. System 100 includes a vehicle 110, a transmitter 120, and a client system 130. Transmitter 120 emits a wireless signal 125 that includes an identifier 140. Client system 130 receives wireless signal 125 and alerts a user 101 to approaching vehicle 110.

User 101 is any person that may be in danger of being struck by vehicle 110. For example, user 101 may be any pedestrian, bicyclist, motorist, traveler, or transportation system worker. In some embodiments, user 101 may be a railroad construction worker.

Vehicle 110 is any vehicle that may pose a threat to user 101. For example, vehicle 110 may be any transit vehicle such as a train, light-rail train, bus, van, passenger car, and the like. Vehicle 110 may also be any non-transit vehicle such as a freight train.

Transmitter 120 is any appropriate device capable of emitting wireless signal 125. In some embodiments, transmitter 120 is a Bluetooth low energy (BTLE) transmitter. In other embodiments, transmitter 120 is a Wi-Fi, classic Bluetooth, or RFID transmitter. In some embodiments, more than one transmitter 120 may be placed on vehicle 110. Transmitter 120 may be placed on a front portion, rear portion, or any other appropriate location on vehicle 110.

Wireless signal 125 is any appropriate wireless signal that is transmitted by transmitter 120. For example, wireless signal 125 may be a BTLE signal, a classic Bluetooth signal, a Wi-Fi signal, or an RFID signal. In some embodiments, wireless signal 125 is a beacon signal that includes identifier 140. Identifier 140 is any appropriate identifier for vehicle 110. In some embodiments, identifier 140 is unique for each particular vehicle 110 or fleet of vehicles 110. In some embodiments, identifier 140 is a beacon ID or media access control (MAC) address of a network device.

Client system 130 is any appropriate system or device that is capable of receiving wireless signal 125. In particular embodiments, client system 130 may be an electronic device including hardware, software, or embedded logic components or a combination of two or more such components and capable of carrying out the appropriate functionalities implemented or supported by client system 130. As an example and not by way of limitation, a client system 130 may include a computer system such as a desktop computer, notebook or laptop computer, netbook, a tablet computer, e-book reader, GPS device, camera, personal digital assistant (PDA), handheld electronic device, cellular telephone, smartphone, augmented/virtual reality device, other suitable electronic device, or any suitable combination thereof. Client system 130 may be a two-way personal mobile communicating device (e.g., smartphone), a one-way communicating device (e.g., a beacon signal receiver with visual, tactile or audible alert capability), or a visual or audible messaging system (e.g., a speaker system, a visual "strobe" light or other sensory input device, a message board, and the like) to alert pedestrians, bicyclists, motorists, or other travelers or systems that vehicle 110 is approaching a known location (e.g., a station).

In operation, transmitter 120 is placed on any vehicle 110 that may pose a threat to users 101 such as pedestrians. In some embodiments, for example, transmitter 120 is placed on the front of vehicle 110 so that it may give the most advanced notice that vehicle 110 is approaching. Transmitter 120 emits wireless signal 125 to be received by client system 130. In some embodiments, wireless signal 125 is a beacon signal. In some embodiments, wireless signal 125 is transmitted continuously while vehicle 110 is in motion or has power. In other embodiments, wireless signal 125 is transmitted only under certain conditions (e.g., if vehicle 110 is moving faster than a certain speed or if vehicle 110 is a certain distance away from a certain location such as a train station as determined by GPS). In some embodiments, wireless signal 125 is transmitted at certain intervals (e.g., every half second, etc.).

Once client system 130 receives wireless signal 125, it may alert user 101 that vehicle 110 is approaching using any appropriate manner. For example, client system 130 may emit any visual, tactile (e.g., vibration) or audible alert, alarm, or message to indicate that vehicle 110 is approaching.

In some embodiments, client system 130 may analyze identifier 140 within wireless signal 125 before alerting user 101 of an approaching vehicle 110. For example, client system 130 may compare identifier 140 to a list of identifiers of known transit vehicles 110. If the received identifier 140 matches an identifier in the list, client system 130 may proceed to alert user 101 of an approaching vehicle 110. In some embodiments, the list of identifiers of known transit vehicles 110 may be in any accessible storage or network location. In some embodiments, the list of identifiers of known transit vehicles 110 may hard-coded within software of client system 130 (e.g., hard-coded within an app running on a smartphone 130). In such embodiments, the list of identifiers of known transit vehicles 110 may be updated by updating the software of client system 130 (e.g., by providing an updated app to smartphone 130). In other embodiments, client system 130 may access the list of identifiers of known transit vehicles 110 that is stored in any accessible network location. For example, an app running on smartphone 130 may access the list of identifiers of known transit vehicles 110 via a network such as the Internet. In such an embodiment, the list of identifiers of known transit vehicles 110 may be stored in any network-accessible or cloud-based server (e.g., host server 320 described below).

As a specific use example, light rail trains of a city's transit system may be outfitted with BTLE transmitters 120. A mobile application may be available for users 101 to install on their smartphones 130. The mobile app on smartphone 130 may detect BTLE signal 125 and alert user 101 that train 110 is approaching. For example, the smartphone 130 may vibrate, emit a noise, and/or display a notification or message of the approaching train 110. As a result, user 101 may be protected from being struck by train 110.

Figure 2:
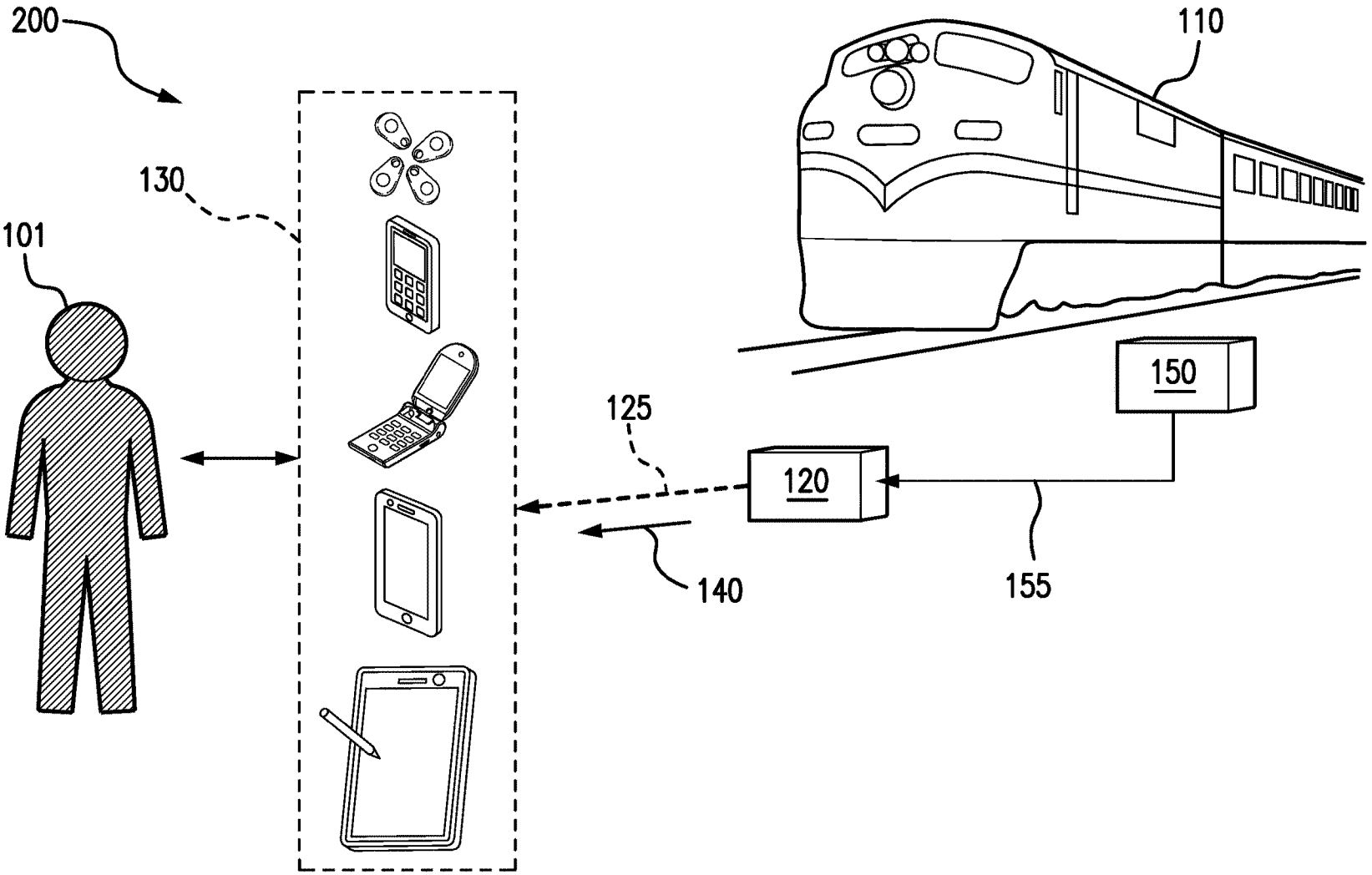

FIG. 2 illustrates a warning system 200 for an approaching vehicle, according to certain embodiments. System 200 is similar to system 100 of FIG. 1, except that transmitter 120 is not placed on vehicle 110. Instead, transmitter 120 is coupled to a fixed location such as a location within a train or bus station. In operation, transmitter 120 receives a trigger signal 155 from a trigger device 150. Trigger device 150 is any appropriate device that detects when vehicle 110 passes by. For example, trigger device 150 may be an amplified inductive loop or contact closure placed on a train track or in a road. Once trigger device 150 detects vehicle 110, it sends trigger signal 155 to transmitter 120. Transmitter 120 then transmits wireless signal 125 to client system 130 as described above with respect to FIG. 1.

Figure 3:
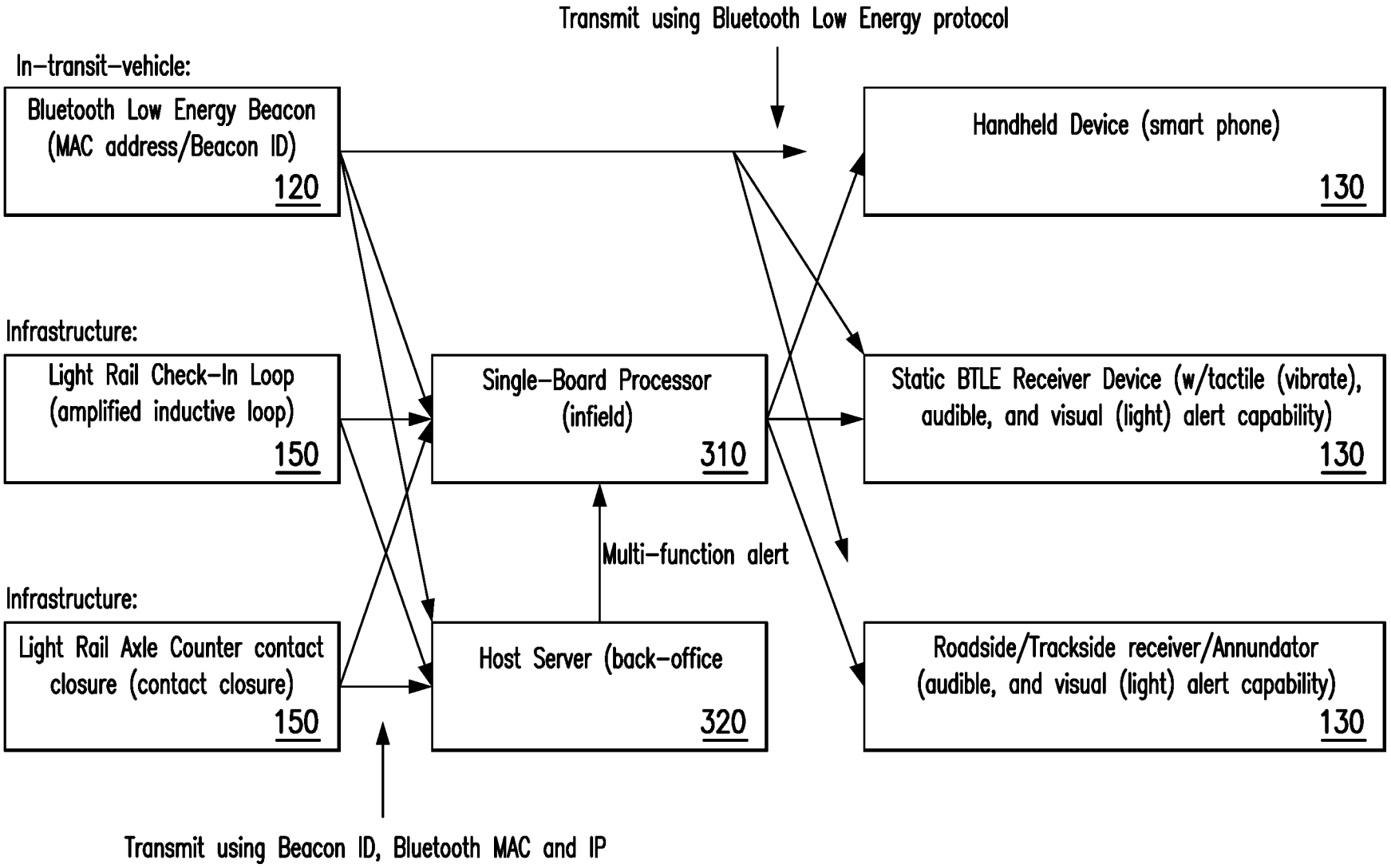
FIG. 3 illustrates a flowchart for various embodiments of warning systems for an approaching vehicle, according to certain embodiments.

FIG. 3 illustrates a flowchart for various embodiments of warning systems for an approaching vehicle, according to certain embodiments. As illustrated in this figure, transmitter 120 may be within vehicle 110 and may transmit wireless signal 125 to one or more client systems 130 or other devices such as an in-field single-board processor 310 or a host server 320. In embodiments that utilize in-field single-board processor 310, the single-board processor 310 may transmit wireless signal 125 to client systems 130 in response to receiving a signal from transmitter 120 or from trigger device 150. In embodiments that utilize host server 320, the host server 320 may transmit a multi-function alert signal to single-board processor 310 in response to receiving a signal from transmitter 120 or from trigger device 150.

In some embodiments, it may be desirable to prevent client system 130 from alerting user 101 that vehicle 110 is approaching. For example, if user 101 is on or within vehicle 110, it would not be desirable for client system 130 to constantly alert user 101 to the presence of vehicle 110. To avoid such scenarios, some embodiments may utilize any appropriate method to determine that user 101 is on or within a specific vehicle 110 and therefore mute or otherwise avoid alerting user 101 to the presence of the specific vehicle 110. As one example, client system 130 may communicate with a server such as host server 320 to determine that user 101 is on board vehicle 110. For example, an app running on smartphone 130 may include a ticketing function that communicates with host server 320 and indicates when user 101 has boarded vehicle 110 (e.g., the app of smartphone 130 may be scanned by a scanner when user 101 boards vehicle 110). As another example, client system 130 may utilize sensors within client system 130 (e.g., accelerometers, GPS transceivers, etc.) to determine a motion (e.g., speed and direction of movement) of client system 130. The determined motion of client system 130 may then be compared to that of vehicle 110 (e.g., by accessing movement data of vehicle 110 stored in a server such host server 320 or movement/speed data of vehicle 110 embedded within wireless signal 125). If the determined motion of client system 130 matches that of vehicle 110 (or is within a certain predetermined percentage of vehicle 110), client system 130 may determine that user 101 is on board vehicle 110 and therefore mute or otherwise avoid alerting user 101 to the presence of vehicle 110.

Figure 4:
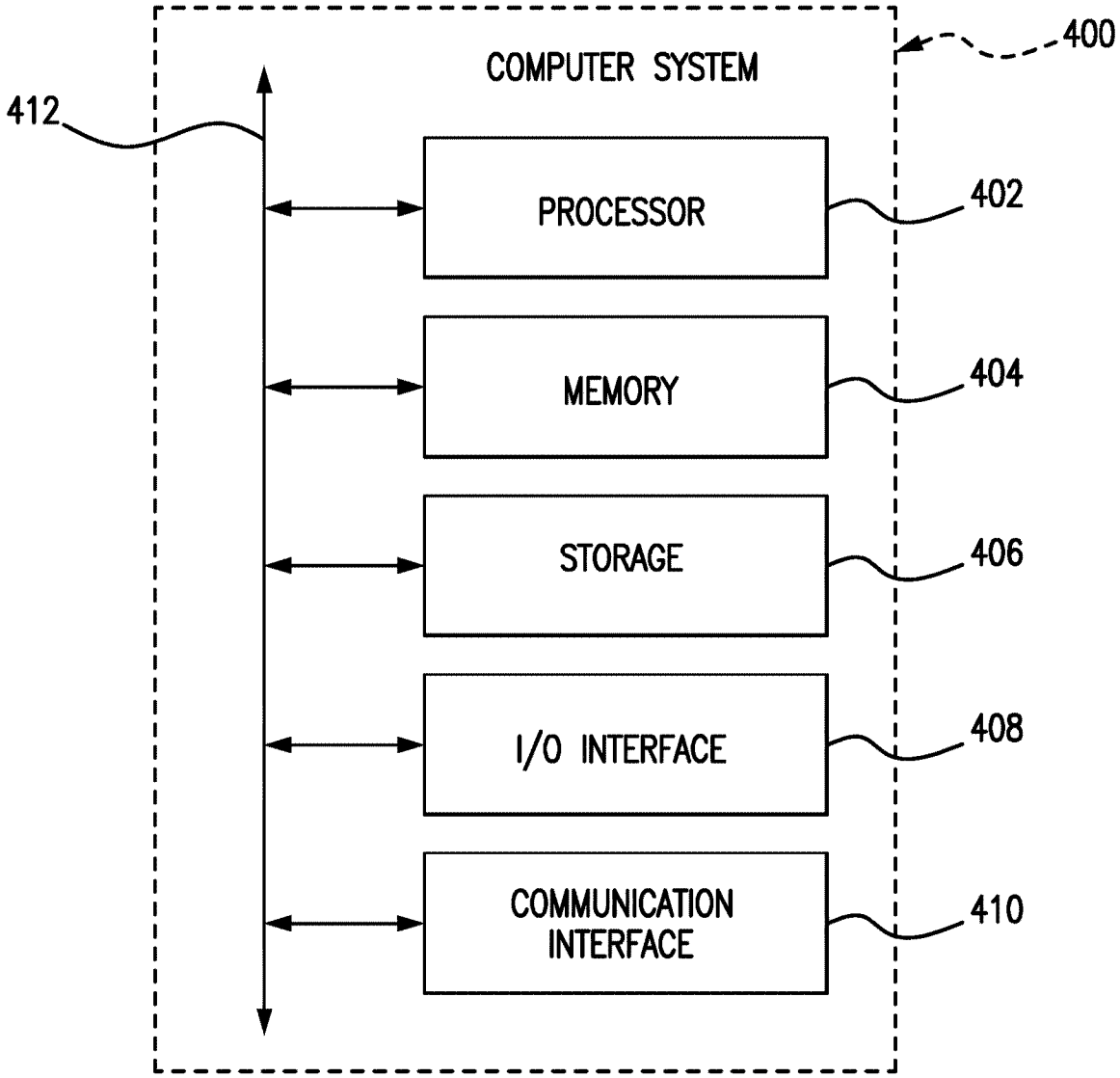
FIG. 4 illustrates a computer system that may be used by the systems of FIGS. 1-3, according to certain embodiments.

FIG. 4 illustrates an example computer system 400. In particular embodiments, one or more computer systems 400 perform one or more steps of one or more methods described or illustrated herein. In particular embodiments, one or more computer systems 400 provide functionality described or illustrated herein. In particular embodiments, software running on one or more computer systems 400 performs one or more steps of one or more methods described or illustrated herein or provides functionality described or illustrated herein. Particular embodiments include one or more portions of one or more computer systems 400. Herein, reference to a computer system may encompass a computing device, and vice versa, where appropriate. Moreover, reference to a computer system may encompass one or more computer systems, where appropriate.

This disclosure contemplates any suitable number of computer systems 400. This disclosure contemplates computer system 400 taking any suitable physical form. As example and not by way of limitation, computer system 400 may be an embedded computer system, a system-on-chip (SOC), a single-board computer system (SBC) (such as, for example, a computer-on-module (COM) or system-on-module (SOM)), a desktop computer system, a laptop or notebook computer system, an interactive kiosk, a mainframe, a mesh of computer systems, a mobile telephone, a personal digital assistant (PDA), a server, a tablet computer system, an augmented/virtual reality device, or a combination of two or more of these. Where appropriate, computer system 400 may include one or more computer systems 400; be unitary or distributed; span multiple locations; span multiple machines; span multiple data centers; or reside in a cloud, which may include one or more cloud components in one or more networks. Where appropriate, one or more computer systems 400 may perform without substantial spatial or temporal limitation one or more steps of one or more methods described or illustrated herein. As an example and not by way of limitation, one or more computer systems 400 may perform in real time or in batch mode one or more steps of one or more methods described or illustrated herein. One or more computer systems 400 may perform at different times or at different locations one or more steps of one or more methods described or illustrated herein, where appropriate.

In particular embodiments, computer system 400 includes a processor 402, memory 404, storage 406, an input/output (I/O) interface 408, a communication interface 410, and a bus 412. Although this disclosure describes and illustrates a particular computer system having a particular number of particular components in a particular arrangement, this disclosure contemplates any suitable computer system having any suitable number of any suitable components in any suitable arrangement.

In particular embodiments, processor 402 includes hardware for executing instructions, such as those making up a computer program. As an example and not by way of limitation, to execute instructions, processor 402 may retrieve (or fetch) the instructions from an internal register, an internal cache, memory 404, or storage 406; decode and execute them; and then write one or more results to an internal register, an internal cache, memory 404, or storage 406. In particular embodiments, processor 402 may include one or more internal caches for data, instructions, or addresses. This disclosure contemplates processor 402 including any suitable number of any suitable internal caches, where appropriate. As an example and not by way of limitation, processor 402 may include one or more instruction caches, one or more data caches, and one or more translation lookaside buffers (TLBs). Instructions in the instruction caches may be copies of instructions in memory 404 or storage 406, and the instruction caches may speed up retrieval of those instructions by processor 402. Data in the data caches may be copies of data in memory 404 or storage 406 for instructions executing at processor 402 to operate on; the results of previous instructions executed at processor 402 for access by subsequent instructions executing at processor 402 or for writing to memory 404 or storage 406; or other suitable data. The data caches may speed up read or write operations by processor 402. The TLBs may speed up virtual-address translation for processor 402. In particular embodiments, processor 402 may include one or more internal registers for data, instructions, or addresses. This disclosure contemplates processor 402 including any suitable number of any suitable internal registers, where appropriate. Where appropriate, processor 402 may include one or more arithmetic logic units (ALUs); be a multi-core processor; or include one or more processors 402. Although this disclosure describes and illustrates a particular processor, this disclosure contemplates any suitable processor.

In particular embodiments, memory 404 includes main memory for storing instructions for processor 402 to execute or data for processor 402 to operate on. As an example and not by way of limitation, computer system 400 may load instructions from storage 406 or another source (such as, for example, another computer system 400) to memory 404. Processor 402 may then load the instructions from memory 404 to an internal register or internal cache. To execute the instructions, processor 402 may retrieve the instructions from the internal register or internal cache and decode them. During or after execution of the instructions, processor 402 may write one or more results (which may be intermediate or final results) to the internal register or internal cache. Processor 402 may then write one or more of those results to memory 404. In particular embodiments, processor 402 executes only instructions in one or more internal registers or internal caches or in memory 404 (as opposed to storage 406 or elsewhere) and operates only on data in one or more internal registers or internal caches or in memory 404 (as opposed to storage 406 or elsewhere). One or more memory buses (which may each include an address bus and a data bus) may couple processor 402 to memory 404. Bus 412 may include one or more memory buses, as described below. In particular embodiments, one or more memory management units (MMUs) reside between processor 402 and memory 404 and facilitate accesses to memory 404 requested by processor 402. In particular embodiments, memory 404 includes random access memory (RAM). This RAM may be volatile memory, where appropriate Where appropriate, this RAM may be dynamic RAM (DRAM) or static RAM (SRAM). Moreover, where appropriate, this RAM may be single-ported or multi-ported RAM. This disclosure contemplates any suitable RAM. Memory 404 may include one or more memories 404, where appropriate. Although this disclosure describes and illustrates particular memory, this disclosure contemplates any suitable memory.

In particular embodiments, storage 406 includes mass storage for data or instructions. As an example and not by way of limitation, storage 406 may include a hard disk drive (HDD), a floppy disk drive, flash memory, an optical disc, a magneto-optical disc, magnetic tape, or a Universal Serial Bus (USB) drive or a combination of two or more of these. Storage 406 may include removable or non-removable (or fixed) media, where appropriate. Storage 406 may be internal or external to computer system 400, where appropriate. In particular embodiments, storage 406 is non-volatile, solid-state memory. In particular embodiments, storage 406 includes read-only memory (ROM). Where appropriate, this ROM may be mask-programmed ROM, programmable ROM (PROM), erasable PROM (EPROM), electrically erasable PROM (EEPROM), electrically alterable ROM (EAROM), or flash memory or a combination of two or more of these. This disclosure contemplates mass storage 406 taking any suitable physical form. Storage 406 may include one or more storage control units facilitating communication between processor 402 and storage 406, where appropriate. Where appropriate, storage 406 may include one or more storages 406. Although this disclosure describes and illustrates particular storage, this disclosure contemplates any suitable storage.

In particular embodiments, I/O interface 408 includes hardware, software, or both, providing one or more interfaces for communication between computer system 400 and one or more I/O devices. Computer system 400 may include one or more of these I/O devices, where appropriate. One or more of these I/O devices may enable communication between a person and computer system 400. As an example and not by way of limitation, an I/O device may include a keyboard, keypad, microphone, monitor, mouse, printer, scanner, speaker, still camera, stylus, tablet, touch screen, trackball, video camera, another suitable I/O device or a combination of two or more of these. An I/O device may include one or more sensors. This disclosure contemplates any suitable I/O devices and any suitable I/O interfaces 408 for them. Where appropriate, I/O interface 408 may include one or more device or software drivers enabling processor 402 to drive one or more of these I/O devices. I/O interface 408 may include one or more I/O interfaces 408, where appropriate. Although this disclosure describes and illustrates a particular I/O interface, this disclosure contemplates any suitable I/O interface.

In particular embodiments, communication interface 410 includes hardware, software, or both providing one or more interfaces for communication (such as, for example, packet-based communication) between computer system 400 and one or more other computer systems 400 or one or more networks. As an example and not by way of limitation, communication interface 410 may include a network interface controller (NIC) or network adapter for communicating with an Ethernet or other wire-based network or a wireless NIC (WNIC) or wireless adapter for communicating with a wireless network, such as a WI-FI network. This disclosure contemplates any suitable network and any suitable communication interface 410 for it. As an example and not by way of limitation, computer system 400 may communicate with an ad hoc network, a personal area network (PAN), a local area network (LAN), a wide area network (WAN), a metropolitan area network (MAN), or one or more portions of the Internet or a combination of two or more of these. One or more portions of one or more of these networks may be wired or wireless. As an example, computer system 400 may communicate with a wireless PAN (WPAN) (such as, for example, a BLUETOOTH WPAN), a WI-FI network, a WI-MAX network, a cellular telephone network (such as, for example, a Global System for Mobile Communications (GSM) network), or other suitable wireless network or a combination of two or more of these. Computer system 400 may include any suitable communication interface 410 for any of these networks, where appropriate. Communication interface 410 may include one or more communication interfaces 410, where appropriate. Although this disclosure describes and illustrates a particular communication interface, this disclosure contemplates any suitable communication interface.

In particular embodiments, bus 412 includes hardware, software, or both coupling components of computer system 400 to each other. As an example and not by way of limitation, bus 412 may include an Accelerated Graphics Port (AGP) or other graphics bus, an Enhanced Industry Standard Architecture (EISA) bus, a front-side bus (FSB), a HYPERTRANSPORT (HT) interconnect, an Industry Standard Architecture (ISA) bus, an INFINIBAND interconnect, a low-pin-count (LPC) bus, a memory bus, a Micro Channel Architecture (MCA) bus, a Peripheral Component Interconnect (PCI) bus, a PCI-Express (PCIe) bus, a serial advanced technology attachment (SATA) bus, a Video Electronics Standards Association local (VLB) bus, or another suitable bus or a combination of two or more of these. Bus 412 may include one or more buses 412, where appropriate. Although this disclosure describes and illustrates a particular bus, this disclosure contemplates any suitable bus or interconnect.

Figure 5:
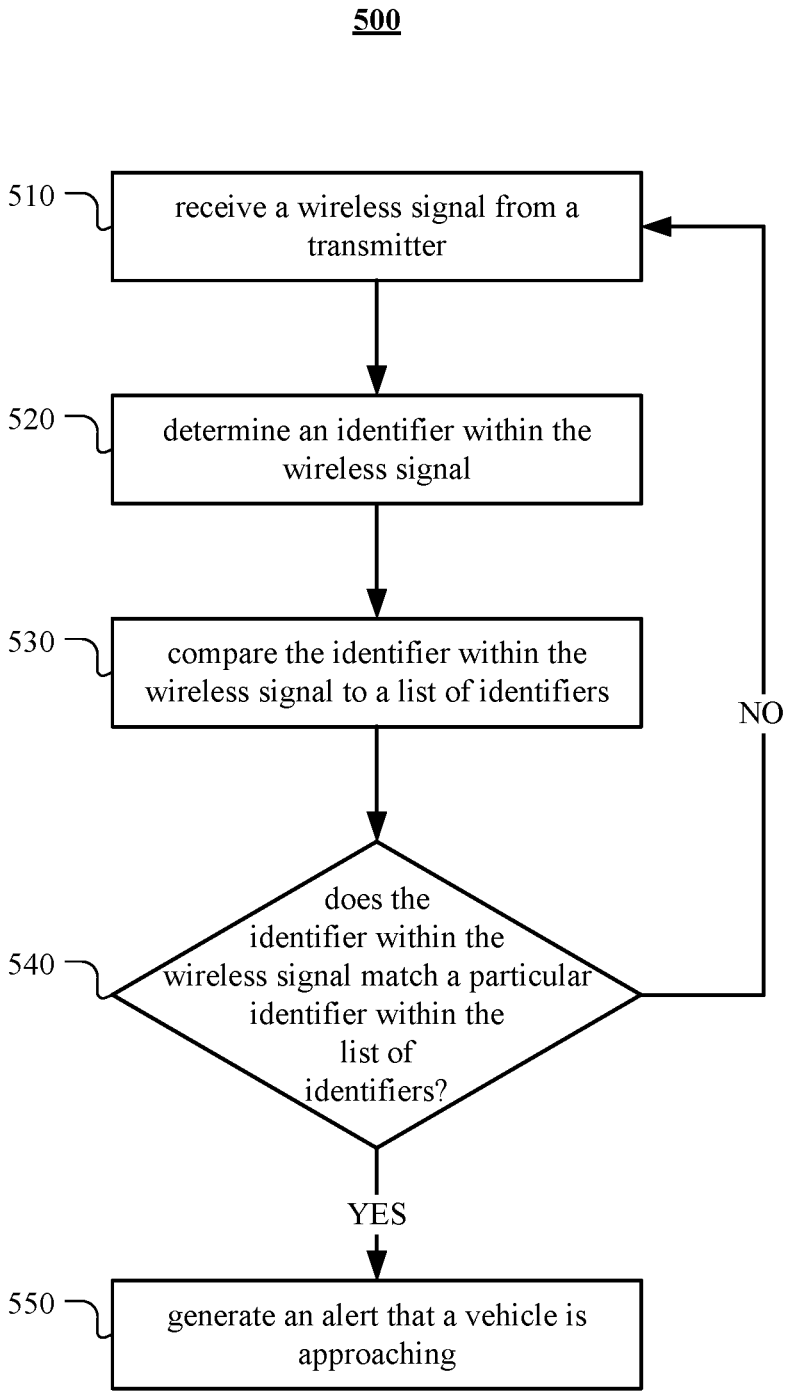
FIG. 5 illustrates an example method for providing an alert that a vehicle is approaching, according to certain embodiments.

FIG. 5 illustrates an example method 500 for providing an alert that a vehicle is approaching. Method 500 may begin at step 510 where a wireless signal is received from a transmitter. In some embodiments, the wireless signal is wireless signal 125. In some embodiments, the wireless signal is received by client system 130 or trigger device 150. In some embodiments, the wireless signal is transmitted by transmitter 120 that may be coupled to a vehicle such as vehicle 110. In some embodiments, the wireless signal is a BTLE signal, a classic Bluetooth signal, a Wi-Fi signal, an RFID signal, or the like.

At step 520, method 500 determines an identifier within the wireless signal received in step 510. In some embodiments, the identifier is identifier 140. In some embodiments, the identifier is a beacon ID, a MAC address of a network device, or the like.

At step 530, method 500 compares the identifier within the wireless signal to a list of identifiers. In some embodiments, the list of identifiers is stored locally on client system 130 (e.g., within memory of client system 130 or embedded within software running on client system 130). In some embodiments, the list of identifiers is retrieved or otherwise accessed from any network or cloud-based server or computer system.

At step 540, method 500 determines whether the identifier within the wireless signal matches a particular identifier within the list of identifiers. If the identifier within the wireless signal matches a particular identifier within the list of identifiers, method 500 proceeds to step 550. If the identifier within the wireless signal does not match any identifier within the list of identifiers, method 500 may proceed back to step 510.

At step 550, method 500 generates an alert that a vehicle is approaching. In some embodiments, the alert is any audible, visual, or tactile alert. After step 550, method 500 may end or proceed back to step 510.

Particular embodiments may repeat one or more steps of method 500 where appropriate. Although this disclosure describes and illustrates particular steps of method 500 as occurring in a particular order, this disclosure contemplates any suitable steps of method 500 occurring in any suitable order. Moreover, although this disclosure describes and illustrates an example method for providing an alert that a vehicle is approaching including the particular steps of method 500, this disclosure contemplates any suitable method for providing an alert that a vehicle is approaching including any suitable steps, which may include all, some, or none of the steps of method 500, where appropriate. Furthermore, although this disclosure describes and illustrates particular components, devices, or systems carrying out particular steps of method 500, this disclosure contemplates any suitable combination of any suitable components, devices, or systems carrying out any suitable steps of method 500.

Herein, a computer-readable non-transitory storage medium or media may include one or more semiconductor-based or other integrated circuits (ICs) (such, as for example, field-programmable gate arrays (FPGAs) or application-specific ICs (ASICs)), hard disk drives (HDDs), hybrid hard drives (HHDs), optical discs, optical disc drives (ODDs), magneto-optical discs, magneto-optical drives, floppy diskettes, floppy disk drives (FDDs), magnetic tapes, solid-state drives (SSDs), RAM-drives, SECURE DIGITAL cards or drives, any other suitable computer-readable non-transitory storage media, or any suitable combination of two or more of these, where appropriate. A computer-readable non-transitory storage medium may be volatile, non-volatile, or a combination of volatile and non-volatile, where appropriate.

Herein, "or" is inclusive and not exclusive, unless expressly indicated otherwise or indicated otherwise by context. Therefore, herein, "A or B" means "A, B, or both," unless expressly indicated otherwise or indicated otherwise by context. Moreover, "and" is both joint and several, unless expressly indicated otherwise or indicated otherwise by context. Therefore, herein, "A and B" means "A and B, jointly or severally," unless expressly indicated otherwise or indicated otherwise by context.

The scope of this disclosure encompasses all changes, substitutions, variations, alterations, and modifications to the example embodiments described or illustrated herein that a person having ordinary skill in the art would comprehend. The scope of this disclosure is not limited to the example embodiments described or illustrated herein. Moreover, although this disclosure describes and illustrates respective embodiments herein as including particular components, elements, feature, functions, operations, or steps, any of these embodiments may include any combination or permutation of any of the components, elements, features, functions, operations, or steps described or illustrated anywhere herein that a person having ordinary skill in the art would comprehend. Furthermore, reference in the appended claims to an apparatus or system or a component of an apparatus or system being adapted to, arranged to, capable of, configured to, enabled to, operable to, or operative to perform a particular function encompasses that apparatus, system, component, whether or not it or that particular function is activated, turned on, or unlocked, as long as that apparatus, system, or component is so adapted, arranged, capable, configured, enabled, operable, or operative. Additionally, although this disclosure describes or illustrates particular embodiments as providing particular advantages, particular embodiments may provide none, some, or all of these advantages.

What is claimed is:

1. A system, comprising:

a transmitter coupled to a vehicle, the transmitter operable to broadcast a wireless signal; and a client system comprising a receiver operable to receive the wireless signal from the transmitter, the client system operable to;

determine an identifier within the wireless signal;

compare the identifier within the wireless signal to a list of identifiers; and in response to determining that the identifier within the wireless signal matches a particular identifier within the list of identifiers, generate an alert that the vehicle is approaching.

2. The system of claim 1, wherein the vehicle comprises:

a freight train;

a transit train;

a bus;

an automobile:;

a truck;

a heavy vehicle;

a tractor;

construction equipment; or road-worthy equipment.

3. The system of claim 1, wherein the transmitter comprises:

a Bluetooth Low Energy transmitter;

a classic Bluetooth transmitter;

a Wi-Fi transmitter;

an RFID transmitter.

4. The system of claim 1, wherein the identifier within the wireless signal comprises one or more of:

a beacon ID; and media access control (MAC) address of a network device.

5. The system of claim 1, wherein the alert comprises one or more of:

an audible alert;

a visual alert; and a tactile alert.

6. The system of claim 1, wherein client system is further operable to:

determine a motion of the client system using one or more sensors of the client system;

determine a motion of the vehicle;

determine whether the motion of the client system matches the motion of the vehicle within a predetermined amount; and prevent any alerts that the vehicle is approaching when the motion of the client system is determined to match the motion of the vehicle within the predetermined amount.

7. The system of claim 1, wherein the client system is further operable to:

determine that the client system is in the vehicle; and prevent any alerts that the vehicle is approaching when it is determined that the client system is in the vehicle.

8. One or more computer-readable non-transitory storage media embodying software that is operable when executed to:

receive a wireless signal from a transmitter;
determine an identifier within the wireless signal;
compare the identifier within the wireless signal to a list of identifiers; and
in response to determining that the identifier within the wireless signal matches a particular identifier within the list of identifiers, generate an alert that a vehicle is approaching.

9. The media of claim 8, wherein the vehicle comprises:
a freight train;
a transit train;
a bus;
an automobile;
a truck;
a heavy vehicle;
a tractor;
construction equipment; or
road-worthy equipment.

10. The media of claim 8, wherein the transmitter comprises:
a Bluetooth Low Energy transmitter;
a classic Bluetooth transmitter;
a Wi-Fi transmitter;
an RFID transmitter.

11. The media of claim 8, wherein the identifier within the wireless signal comprises one or more of:
a beacon ID; and
media access control (MAC)address of a network device.

12. The media of claim 8, wherein the alert comprises one or more of:
an audible alert;
a visual alert; and
a tactile alert.

13. The media of claim 8, wherein the software is further operable when executed to:
determine a motion of a client system using one or more sensors of the client system;
determine a motion of the vehicle;
determine whether the motion of the client system matches the motion of the vehicle within a predetermined amount; and
prevent any alerts that the vehicle is approaching when the motion of the client system is determined to match the motion of the vehicle within the predetermined amount.

14. The media of claim 8, wherein the software is further operable when executed to:
determine that a client system is in the vehicle; and
prevent any alerts that the vehicle is approaching when it is determined that the client system is in the vehicle.

15. A system comprising:
one or more processors; and
one or more computer-readable non-transitory storage media coupled to one or more of the processors and comprising instructions operable when executed by one or more of the processors to cause the system to:
receive a wireless signal from a transmitter;
determine an identifier within the wireless signal;
compare the identifier within the wireless signal to a list of identifiers; and
in response to determining that the identifier within the wireless signal matches a particular identifier within the list of identifiers, generate an alert that a vehicle is approaching.

16. The system of claim 15, wherein the transmitter comprises:
a Bluetooth Low Energy transmitter;
a classic Bluetooth transmitter;
a Wi-Fi transmitter;
an RFID transmitter.

17. The system of claim 15, wherein the identifier within the wireless signal comprises one or more of:
a beacon ID; and
media access control (MAC) address of a network device.

18. The system of claim 15, wherein the alert comprises one or more of:
an audible alert;
a visual alert; and
a tactile alert.

19. The system of claim 15, wherein the instructions are further operable when executed by one or more of the processors to cause the system to:
determine a motion of the system using one or more sensors of the system;
determine a motion of the vehicle;
determine whether the motion of the system matches the motion of the vehicle within a predetermined amount; and
prevent any alerts that the vehicle is approaching when the motion of the system is determined to match the motion of the vehicle within the predetermined amount.

20. The system of claim 15, wherein the instructions are further operable when executed by one or more of the processors to cause the system to:
determine that the system is in the vehicle; and
prevent any alerts that the vehicle is approaching when it is determined that the system is in the vehicle.

* * * * *